US007942200B2

(12) United States Patent
Palacios et al.

(10) Patent No.: US 7,942,200 B2
(45) Date of Patent: May 17, 2011

(54) DOWNHOLE FLUID INJECTION DISPERSION DEVICE

(76) Inventors: Carlos A. Palacios, Lecheria (VE); Robert Sunyovszky, Maracaibo (VE)

( * ) Notice: Subject to any disclaimer, the term of this patent is extended or adjusted under 35 U.S.C. 154(b) by 271 days.

(21) Appl. No.: 12/261,247

(22) Filed: Oct. 30, 2008

(65) Prior Publication Data

US 2010/0108309 A1 May 6, 2010

(51) Int. Cl.
*E21B 21/00* (2006.01)

(52) U.S. Cl. ..... 166/222

(58) Field of Classification Search ..... 166/222, 166/223, 242.5
See application file for complete search history.

(56) References Cited

U.S. PATENT DOCUMENTS 4,031,955 A 6/1977 Ledet
4,291,763 A 9/1981 Singer
4,347,899 A 9/1982 Weeter
4,589,482 A 5/1986 Bayh, III
4,625,803 A 12/1986 Walhaug et al.
4,637,469 A 1/1987 Spriggs et al.
4,665,981 A 5/1987 Hayatdovoudi
5,056,599 A 10/1991 Comeaux et al.
5,117,913 A 6/1992 Themig
5,188,179 A 2/1993 Gay et al.
5,924,490 A * 7/1999 Stone ..... 166/312
6,135,210 A 10/2000 Rivas
6,289,987 B1 * 9/2001 Lay, Jr. ..... 166/169
6,382,316 B1 5/2002 Kintzele

* cited by examiner

*Primary Examiner* — David J Bagnell
*Assistant Examiner* — David Andrews
(74) *Attorney, Agent, or Firm* — Duane Morris LLP

(57) ABSTRACT

The invention described herein is directed to a downhole fluid injection dispersion device. This invention may be employed to radially disperse fluid injected downhole in a well bore. This invention comprises a body comprising an inlet port and at least two radial outlet ports.

6 Claims, 2 Drawing Sheets

DOWNHOLE FLUID INJECTION DISPERSION DEVICE

FIELD OF THE INVENTION

The invention described herein is directed to a downhole fluid injection dispersion device. This invention may be employed to radially disperse fluid injected downhole in a well bore. This invention comprises a body comprising an inlet port and at least two radial outlet ports.

BACKGROUND OF THE INVENTION

In hydrocarbon production chemicals are introduced into a well through a capillary tube for mitigating problems, such as scaling, corrosion, or the deposition of organic products. Chemicals are also introduced in this manner to treat well fluids, reduce viscosity, and/or demulsify.

In prior art downhole chemical injection methods using a single capillary tube, the injected chemicals are not widely dispersed in the radial dimension, resulting in limited mixing of the chemicals and well fluids. This limited mixing can result in chemicals channeling on one side of an electrical submersible pump ("ESP") located downhole. Such channeling leaves a side or portion of the ESP untreated. Additionally, capillary tubes used with prior art downhole chemical injection devices have been subject to plugging, resulting in a lack of chemical dispersion downhole to protect the ESP.

Another prior art chemical injection method involves injecting chemicals from the well surface into the well annulus. This method involves the chemicals flowing downward as a countercurrent to the gases that are liberated at the pump separator. In this method, the chemicals flow downhole to mix with production fluids and enter the intake or suction of the ESP. Once the mixture of production fluids and chemicals reach the ESP intake, they are discharged from the ESP, rather than flowing down past the ESP motor. Thus, components below the ESP intake, such as the motor, do not receive the intended treatment benefit of the injected chemicals. Downhole motors are especially susceptible to corrosion due to their high operating temperatures.

One or more embodiments of the invention described herein provide improved dispersion of fluids injected downhole and protection of the capillary tube against plugging, for various forms of oil production systems.

DESCRIPTION OF THE PREFERRED EMBODIMENTS

Figure 3:
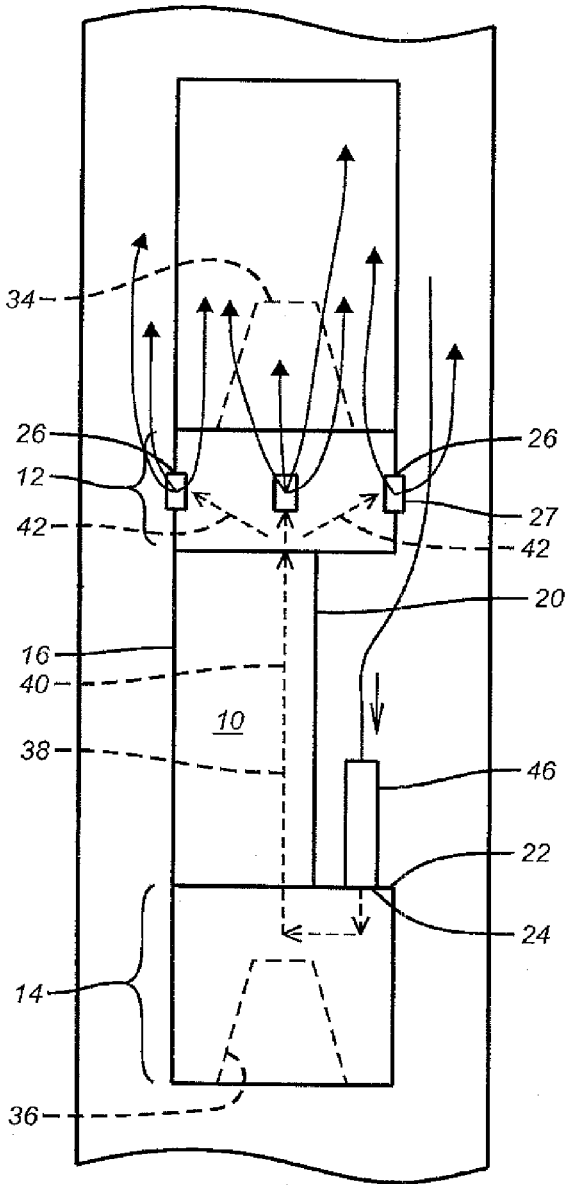
FIG. 3 is a cross sectional view of a first preferred embodiment of the invention.
Figure 4:
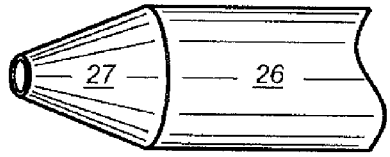
FIG. 4 is a side view of a nozzle for use with various embodiments of the invention.

A first preferred embodiment of the invention is shown in FIG. 3. In a first preferred embodiment, the invention comprises a body 10 comprising a first body region 12, a second body region 14 opposite the first body region, an outer longitudinal surface 16 positioned between the first and second body regions and comprising an indented surface region 20 between the first and second body regions, a first ledge 22, and an inlet port 24 in the first ledge; and at least two radial outlet ports 26 mounted on opposite sides of the first body region This first embodiment further comprises a first mechanical coupling 34 connected to the first body region, and a second mechanical coupling 36 connected to the second body region. In a preferred embodiment the second mechanical coupling comprises female pipe threads. In a preferred embodiment the first mechanical coupling comprises male pipe threads.

This first embodiment further comprises an internal flow path 38 in fluid communication with the inlet port, said internal flow path comprising a first segment 40 extending longitudinally through the body, and at least two radial segments 42, each of which is in fluid communication with one of the radial outlet ports. In a preferred embodiment radial segments extend in an orientation that is substantially perpendicular to the orientation of the first segment.

Another preferred embodiment comprises the limitations of the first embodiment plus a nozzle 27 connected to each radial outlet port.

Another preferred embodiment comprises the limitations of the first embodiment plus a check valve 46 installed in the inlet port and positioned to allow fluid flow into the inlet port and body, and to prevent fluid flow out of the inlet port and body.

Figure 2:
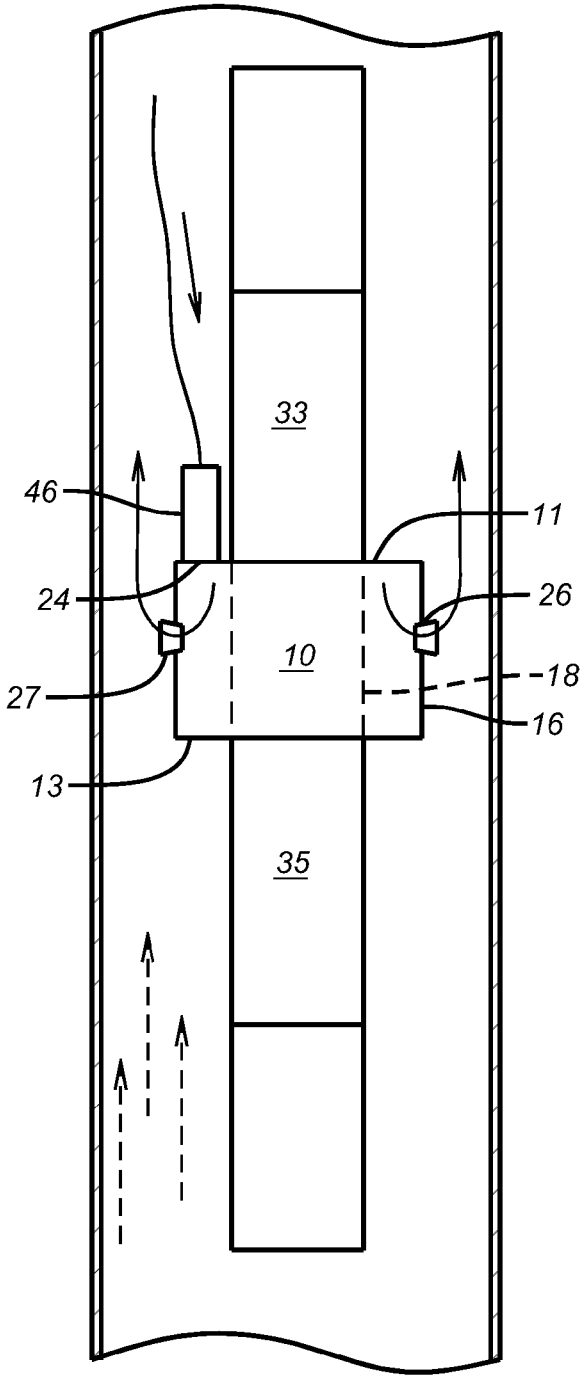
FIG. 2 is a cross sectional view of a second preferred embodiment of the invention.

A second preferred embodiment of the invention is shown in FIG. 2. In a second preferred embodiment, the invention comprises a body 10 comprising a first outer surface 11 comprising an inlet port 24, a second outer surface 13 opposite the first outer surface, an outer longitudinal surface 16 between the first outer surface and second outer surface, an inner longitudinal surface 18 between the first outer surface and second outer surface defining a central longitudinal channel, at least two radial outlet ports 26 mounted on opposite sides of the outer longitudinal surface, each of said outlet ports being in fluid communication with the inlet port.

This second embodiment further comprises a first tubing member 33 extending out of the central longitudinal channel in a first direction and a second tubing member 35 extending out of the central longitudinal channel in a second direction opposite to the first direction.

Another preferred embodiment comprises the limitations of the second embodiment plus a check valve 46 installed in the inlet port and positioned to allow fluid flow into the inlet port and body, and to prevent fluid flow out of the inlet port and body.

In another preferred embodiment, the body comprises at least four radial outlet ports 26, each of which is mounted on a different quadrant of the inner longitudinal surface and is in fluid communication with the inlet port.

Another preferred embodiment comprises the limitations of the second embodiment plus a nozzle 27 connected to each radial outlet port.

Figure 1:
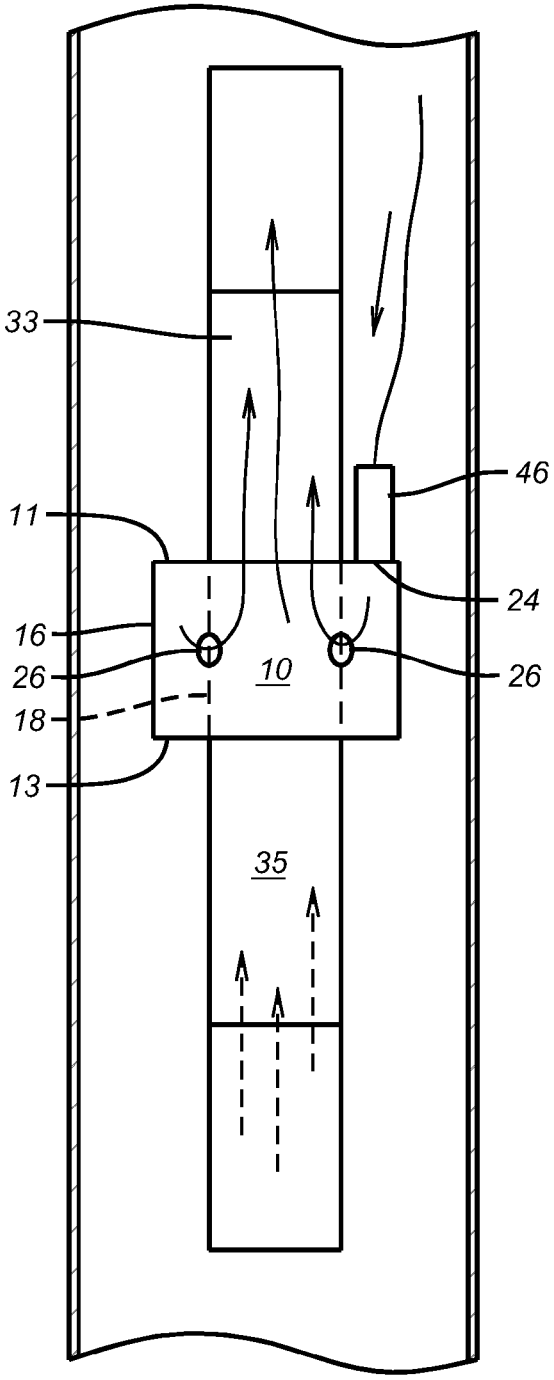
FIG. 1 is a cross sectional view of a third preferred embodiment of the invention.

A third preferred embodiment of the invention is shown in FIG. 1. In a third preferred embodiment, the invention comprises a body 10 comprising a first outer surface 11 comprising an inlet port 24, a second outer surface 13 opposite the first outer surface, an outer longitudinal surface 16 between the first outer surface and second outer surface; an inner longitudinal surface 18 between the first outer surface and second outer surface defining a central longitudinal channel, and at least two radial outlet ports 26 mounted on opposite sides of the inner longitudinal surface, each of said outlet ports being in fluid communication with the inlet port.

This third embodiment further comprises a first tubing member 33 extending out of the central longitudinal channel in a first direction and a second tubing member 35 extending out of the central longitudinal channel in a second direction opposite to the first direction.

Another preferred embodiment comprises the limitations of the third embodiment plus a check valve 46 installed in the inlet port and positioned to allow fluid flow into the inlet port and body, and to prevent fluid flow out of the inlet port and body.

In another preferred embodiment, the body comprises at least four radial outlet ports 26, each of which is mounted on a different quadrant of the inner longitudinal surface and is in fluid communication with the inlet port.

Another preferred embodiment comprises the limitations of the third embodiment plus a nozzle 27 connected to each radial outlet port.

In a fourth preferred embodiment, the invention comprises a body 10 comprising a first outer surface 11 comprising an inlet port 24, a second outer surface 13 opposite the first outer surface, a longitudinal surface 16 between the first outer surface and second outer surface, The fourth preferred embodiment further comprises at least two radial outlet ports 26 mounted on opposite sides of the longitudinal surface, each of said outlet ports being in fluid communication with the inlet port Another preferred embodiment comprises the limitations of the fourth embodiment plus a nozzle 27 connected to each radial outlet port.

The foregoing disclosure and description of the inventions are illustrative and explanatory. Various changes in the size, shape, and materials, as well as in the details of the illustrative construction may be made without departing from the spirit of the invention.

What is claimed is:

1. A downhole fluid injection dispersion device, comprising:

a. a body comprising:
   i. first body region,
   ii. a second body region opposite the first body region,
   iii. an outer longitudinal surface positioned between the first and second body regions; and comprising an indented surface region between the first and second body regions, a first ledge, and an inlet port in the first ledge; and
   iv. at least two radial outlet ports mounted on opposite sides the first body region;

b. a first mechanical coupling connected to the first body region;

c. a second mechanical coupling connected to the second body region; and d. an internal flow path in fluid communication with the inlet port, said internal flow path comprising a first segment extending longitudinally through the body, and at least two radial segments, each of which is in fluid communication with one of the radial outlet ports.

2. The device of claim 1, wherein the second mechanical coupling comprises female pipe threads.

3. The device of claim 1, further comprising a nozzle connected to each radial outlet port.

4. The device Of claim 1, wherein the first mechanical coupling comprises male pipe threads.

5. The device of claim 1, wherein radial segments extend in an orientation that is substantially perpendicular to the orientation of the first segment.

6. The device of claim 1, further comprising a check valve installed in the inlet port and positioned to allow fluid flow into the inlet port and body, and to prevent fluid flow out of the inlet port and body.

* * * * *